US007334545B2

(12) United States Patent
Müller

(10) Patent No.: US 7,334,545 B2
(45) Date of Patent: Feb. 26, 2008

(54) METHOD AND COOLING SYSTEM FOR COOLING AN INTERNAL COMBUSTION ENGINE

(75) Inventor: Stephan Müller, Leonberg (DE)

(73) Assignee: Dr. Ing. h.c. F. Porsche AG, Stuttgart (DE)

( * ) Notice: Subject to any disclaimer, the term of this patent is extended or adjusted under 35 U.S.C. 154(b) by 0 days.

(21) Appl. No.: 11/645,824

(22) Filed: Dec. 26, 2006

(65) Prior Publication Data

US 2007/0144464 A1 Jun. 28, 2007

(30) Foreign Application Priority Data

Dec. 24, 2005 (DE) ..... 10 2005 062 294

(51) Int. Cl.
*F01P 7/16* (2006.01)
*F01P 3/02* (2006.01)

(52) U.S. Cl. ..... 123/41.31; 123/41.08

(58) Field of Classification Search ..... 123/41.02, 123/41.05, 41.08, 41.29, 41.31
See application file for complete search history.

(56) References Cited

U.S. PATENT DOCUMENTS 4,381,736 A * 5/1983 Hirayama ..... 123/41.1
4,726,325 A 2/1988 Itakura
6,340,006 B1 * 1/2002 Malatto et al. ..... 123/41.29
6,595,164 B2 7/2003 Kunze et al.
6,758,171 B2 * 7/2004 Hwang ..... 123/41.05
6,810,838 B1 * 11/2004 Hellman ..... 123/41.28
6,976,892 B2 * 12/2005 Tawa et al. ..... 440/88 G
7,055,467 B2 * 6/2006 Yi ..... 123/41.29
7,207,298 B2 * 4/2007 Lee ..... 123/41.29
2003/0000487 A1 1/2003 Schmitt

FOREIGN PATENT DOCUMENTS

DE 199 38 614 A1 2/2001
DE 100 32 184 A1 1/2002
DE 101 19 969 A1 10/2002
DE 101 63 943 A1 7/2003

* cited by examiner

*Primary Examiner*—Hai Huynh

(57) ABSTRACT

In a method for cooling an internal combustion engine, in particular in/on a motor vehicle, it is possible for individual components of the internal combustion engine to be cooled individually, for example a cylinder head and/or a cylinder block, by what is known as a split cooling system. In order to improve the cooling of the components, it is proposed to control the cooling of at least one of the components adaptively.

14 Claims, 1 Drawing Sheet

METHOD AND COOLING SYSTEM FOR COOLING AN INTERNAL COMBUSTION ENGINE

CROSS-REFERENCE TO RELATED APPLICATION

This application claims the priority, under 35 U.S.C. §119, of German application DE 10 2005 062 294.1, filed Dec. 24, 2005; the prior application is herewith incorporated by reference in its entirety.

BACKGROUND OF THE INVENTION

Field of the Invention

The invention relates to a method for cooling an internal combustion engine, in particular in/on a motor vehicle. It is possible for individual components of the internal combustion engine to be cooled individually, in particular a cylinder head and/or a cylinder block. Moreover, the invention relates to a cooling system for an internal combustion engine, which cooling system operates by way of split cooling system.

In modern engine cooling concepts of internal combustion engines, the temperature of the coolant can be set according to requirements. Therefore, for example, one can set a higher temperature of the components in part load operation than under full load. As a result of the reduced viscosity of the lubricant at a higher temperature, the friction is reduced and therefore the consumption is improved, and in addition HC emissions are reduced. A contribution can be made to the rational reduction of pollutant emission and fuel consumption by way of the strategy of engine heat management. In what is known as the split cooling concept, the temperature levels of the cylinder head and the cylinder block are regulated separately. In all these approaches, however, the handling of the overall system is disadvantageous at highly dynamic transitions from the warmer part load into full load at desired lower component temperatures. The lower temperatures at full load are required, in order to maximize the filling of fresh air and to retain the knocking limit at as early an ignition angle as possible. It is relatively simple here to change the coolant temperature rapidly, whereas the thermal inertia of the overall engine mass permits only slow cooling of the relevant components.

U.S. Pat. No. 6,595,164 B2 discloses a split cooling concept, in which cooling water flows through a cylinder head and a cylinder block in parallel. The coolant flow in the cylinder head and in the cylinder block can be controlled individually by thermostat valves or electrically actuable valves, the thermostat valves permitting, however, only passive control of the coolant temperature and therefore the engine temperature.

Published, non-prosecuted German patent application DE 101 63 943 A1 discloses a method for actuating electrically actuable components of a cooling system for an internal combustion engine of a motor vehicle. The components are actuated by a control unit as a function of the current operating point of the motor vehicle, in such a way that an optimum overall efficiency of the motor vehicle and/or the cooling system results. In general, the known method serves for cooling an internal combustion engine which is configured as a central unit, individual cooling of individual components of the internal combustion engine not being provided.

SUMMARY OF THE INVENTION

It is accordingly an object of the invention to provide a method and a cooling system for cooling an internal combustion engine which overcome the above-mentioned disadvantages of the prior art methods and devices of this general type, which results in a positive effect, in particular, on the energy consumption and the pollutant emissions.

The invention is based on the general concept that, in an internal combustion engine, in particular in/on a motor vehicle, having individual components which can be cooled individually, such as a cylinder head and/or a cylinder block, the cooling of at least one of these components is controlled adaptively. The adaptive control of the cooling can be realized here both by stipulations which are dependent on a request of the driver, for example in a similar manner to a transmission selection switch "economy/sport", and also by an adaptation of the coolant temperature of individual components of the internal combustion engine to dynamic driving data. Moreover, the adaptive control is also to include electronic data processing systems, such as processors, control units and computers which analyze and evaluate driving situations from the past and, as a result, control the cooling of the individual engine components in the future in an improved manner. The adaptive control therefore also includes controllers which are independent and/or capable of learning and permit the optimum control of the coolant temperature using predefined parameters.

In particular, highly dynamic transitions from the warmer part load to full load at simultaneously desired lower component temperatures can be realized in an improved manner with the adaptive control of the cooling. Moreover, the warm-up time of the engine can be shortened and the temperature of the internal combustion engine in the part load range can be increased, as a result of which the engine can be operated at a more favorable friction level and therefore consumes less fuel.

According to one advantageous embodiment of the solution according to the invention, the adaptive controller determines a degree of driving dynamics and regulates the cooling as a function of the latter. Depending on the driving dynamics which are determined, different component setpoint temperatures can therefore be set, in a comparable manner to the gearshift point strategy in automatic transmissions, and a reduction in the fuel consumption can likewise be achieved as a result. If, for example, a sporty driving behavior is determined, lower temperatures are selected, whereas high temperatures which are optimum in terms of consumption are predefined by the adaptive controller in the case of a comfort driving style. A higher temperature of the components can be achieved in part load operation than under full load as a result of the setting according to requirements of the temperature of the coolant, the reduced viscosity of the lubricant which is associated with a higher temperature bringing about a reduction in the friction and, as a result, it being possible for an improvement in the consumption to be achieved in addition to reduced pollutant emission.

In a further particularly favorable embodiment, the adaptive controller processes dynamic data, in particular dynamic driving data, in order to regulate the cooling and/or in order to determine the degree of driving dynamics. Dynamic driving data of this type allow conclusions to be drawn about the respective driving style or the requirements made on the motor vehicle as a result of operation. As a result of this, the controller recognizes in which driving situation the vehicle is currently situated, and can therefore adapt the coolant temperature according to requirements to the respective driving situation.

The dynamic data are advantageously determined in a manner which is dependent on a request of the driver and/or as a function of at least one of the following parameters: throttle valve position and/or throttle valve gradient and/or rotational speed level and/or who rotational speed gradient. If the dynamic data are stipulated in a manner which is dependent on a request of the driver, for example in a similar manner to a selection switch between economy and sport in an automatic transmission, the driver of the motor vehicle can therefore have an active influence on the control of the coolant temperature and therefore the heat management in the engine. If the dynamic data are determined as a function of abovementioned parameters, the heat management of the engine and the cooling are controlled independently of the driver and are adapted constantly to the respective driving situation as a result. Here, the throttle valve position or the rotational speed level can be detected by simple and inexpensive sensors (these data are usually already available in current engine controllers), as a result of which the marketability of the adaptive control can be improved.

In another development of the invention, different dependences are provided between the degree of driving dynamics and the cooling in the case of the different components of the internal combustion engine. This can achieve a situation, for example, where the cylinder head has a different temperature profile than the cylinder block as a function of the degree of driving dynamics.

Moreover, the invention is based on the general concept of providing a cooling system for an internal combustion engine, which cooling system is configured as what is known as a "split cooling system", with the result that individual components of the internal combustion engine can be cooled individually, in particular a cylinder head and/or a cylinder block, the cooling system having an adaptive controller which is configured for regulating the cooling of at least one of the components. As a result, the advantages of the "split cooling system" can be combined with active control of the heat management of the engine, as a result of which improved consumption, friction and pollutant emission values can be achieved.

It goes without saying that the features which are mentioned in the preceding text and are still to be explained in the text which follows can be used not only in the respectively specified combination, but also in other combinations or alone, without departing from the scope of the present invention.

Other features which are considered as characteristic for the invention are set forth in the appended claims.

Although the invention is illustrated and described herein as embodied in a method and a cooling system for cooling an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
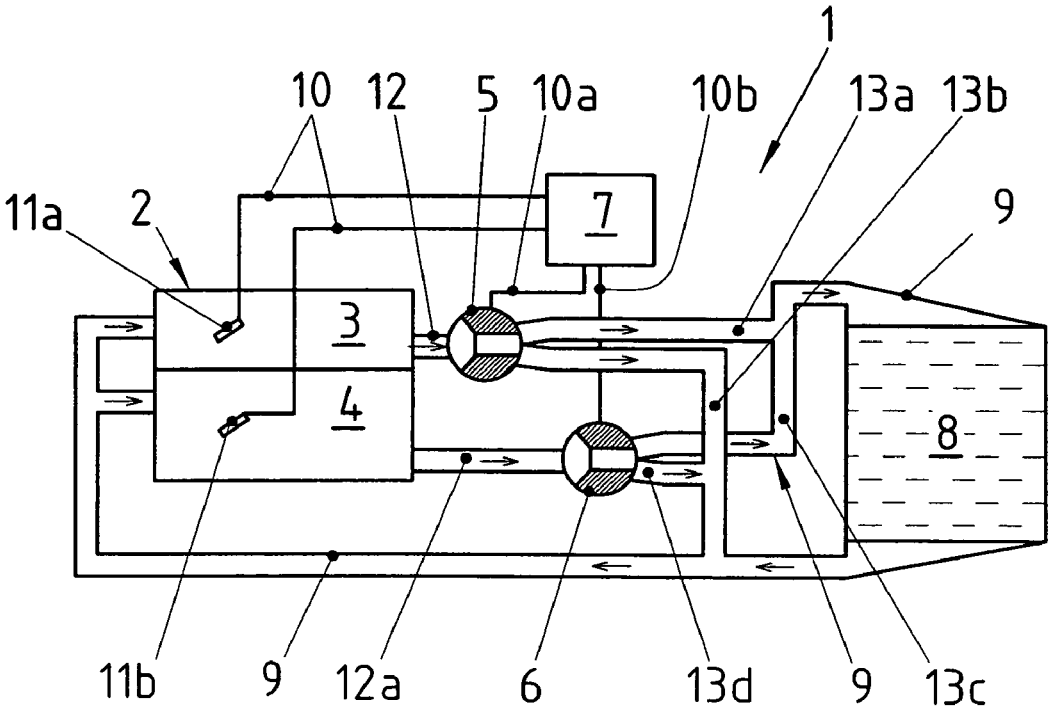
FIG. 1 is a diagrammatic, simplified illustration of a cooling system according to the invention.

Referring now to the figures of the drawing in detail and first, particularly, to FIG. 1 thereof, there is shown in very diagrammatic form a cooling system 1 according to the invention which includes an internal combustion engine 2 which has a cylinder head 3 and a cylinder block 4, a first valve 5, a second valve 6, an adaptive controller 7, and a radiator 8. Coolant lines 9, in which a coolant flows, are disposed between the internal combustion engine 2, the two valves 5 and 6 and the radiator 8. The flow direction of the coolant is indicated here by arrows within the coolant lines 9.

An input side of the adaptive controller 7 is connected via connecting lines 10, for example electric lines, both to a temperature sensor 11*a* in the cylinder head 3 and to a temperature sensor 11*b* in the cylinder block 4. An output side of the adaptive controller 7 is connected by way of a further connecting line 10*a* to the first valve 5, the connecting line 10*a* serving to transmit control pulses from the adaptive controller 7 to the first valve 5. As is shown further in FIG. 1, the adaptive controller 7 is connected via the connecting line 10*b* to the second valve 6 in order to control the latter. Here, the adaptive controller 7 can be configured, for example, as an electronic control unit (ECU), as a processor, as a PC or as a control device.

The first valve 5 and the second valve 6 can be configured, for example, as three-way valves, and are preferably electrically actuable. The first valve 5 is connected on the input side to the cylinder head 3 via an inlet channel 12, whereas it has two outlet channels 13*a* and 13*b* on the output side, of which one outlet channel 13*a* is connected to the radiator 8 and the other outlet channel 13*b* forms a bypass line which bypasses the radiator 8. The second valve 6 is connected on an inlet side to the cylinder block 4 via an inlet channel 12*a*, whereas it has two outlet channels 13*c* and 13*d* on the outlet side. Here, the one outlet channel 13*c* is connected to the radiator 8, like the outlet channel 13*a* of the first valve 5, and the other outlet channel 13*d* of the second valve 6 is connected to a bypass line which bypasses the radiator 8, like the outlet channel 13*b* of the first valve 5.

Depending on the position of the first valve 5, either a coolant through flow stop or a 100% through flow rate via the one outlet channel 13*a* and the radiator 8 back to the internal combustion engine 2, or a 100% through flow rate via the other outlet channel 13*b* via the bypass line past the radiator 8 and back into the internal combustion engine 2, and any desired intermediate position, in which different through flow rates are distributed to the outlet channels 13*a* and 13*b*, can therefore be set for the cooling of the cylinder head 3. The same is correspondingly true for the second valve 6 and the cooling of the cylinder block 4. The cooling system 1 of the internal combustion engine 2 is therefore configured as what is known as a "split cooling system" which allows individual components of the internal combustion engine 2, in particular the cylinder head 3 and/or the cylinder block 4, to be cooled individually and therefore according to requirements and in a manner which optimizes the consumption.

Here, the adaptive controller 7 can determine a degree of driving dynamics and regulate the cooling of the internal combustion engine 2 or the individual components 3, 4 as a function of the degree of driving dynamics. Therefore, for example in part load operation, a higher temperature of the components 3, 4 can be set, and a reduction in the friction and therefore an improvement in consumption can be achieved by a high temperature in conjunction with the reduced viscosity of the lubricant. Moreover, the HC emissions are reduced. In order to regulate the cooling and/or in order to determine the degree of driving dynamics, the adaptive controller 7 processes dynamic data, in particular dynamic driving data. Dynamic data of this type can be determined, for example, in a manner which is dependent on a request of the driver, in a similar manner to an "economy/sport" selection switch of an automatic transmission, and/or as a function of individual dynamic driving parameters, such as a throttle valve position and/or a throttle valve gradient and/or a rotational speed level and/or a rotational speed gradient. This makes it possible to set increased cooling in the case of a sporty driving behavior, that is to say with a high degree of driving dynamics or under full load, whereas reduced cooling can take place in the case of a comfort driving style, that is to say with a low degree of driving dynamics. It is possible here to provide different dependences between the degree of driving dynamics and the cooling in the case of the different components 3, 4 according to FIG. 2.

Figure 2:
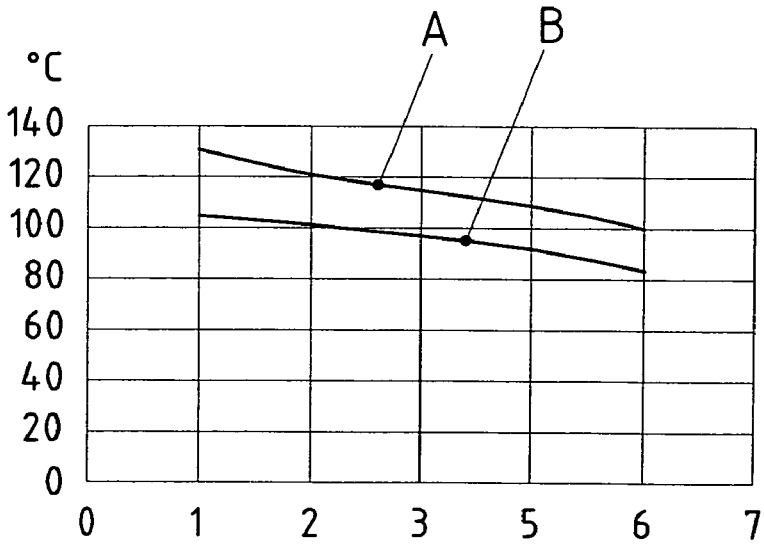
FIG. 2 is a graph in which a setpoint temperature for a cylinder and a cylinder head is shown in each case as a function of a degree of driving dynamics.

FIG. 2 shows a component setpoint temperature (ordinate), that is to say the setpoint temperature A which can be set at the cylinder block 4 and the setpoint temperature B which can be set at the cylinder head 3, as a function of the degree of driving dynamics (abscissa). Here, the degree of driving dynamics is shown in a rising manner on the abscissa by the numerical values 0 to 7. In the case of a low degree of driving dynamics, higher values can be tolerated both for the setpoint temperature A at the cylinder block 4 and for the setpoint temperature B at the cylinder head 3, whereas the component temperature at both components 3, 4 should be reduced via increased cooling in the case of a high degree of driving dynamics. The lower temperatures in the case of a sporty driving behavior (high degree of driving dynamics) or under full load are required, in order to maximize the filling of fresh air and to retain the knocking limit at as early ignition angles as possible. This is required, in order to obtain an optimum full load moment.

As is shown in FIG. 2, the setpoint temperature A at the cylinder block 4 always lies above the setpoint temperature B at the cylinder head 3 here, both temperature profiles extending almost in a straight line and in parallel. It goes without saying that other temperature profiles as a function of the degree of driving dynamics are also conceivable. The adaptive controller 7 sets the temperature of the cylinder head 3 constantly below the temperature of the cylinder block 4 here, that is to say independently of the degree of driving dynamics, and therefore aids the reduction in the friction and the pollutant emissions, and optimization of the consumption.

In summary, the substantial features of the invention are now characterized.

The method according to the invention for cooling the internal combustion engine 2, in which individual components, for example the cylinder head 3 and/or the cylinder block 4, can be cooled individually, makes it possible for the cooling of at least one of the two components 3, 4 to be controlled adaptively. The adaptive control of the engine cooling achieves an improvement in the engine full load and an optimum consumption in the part load. At the same time, the handling of the overall system is made easier at highly dynamic transitions from the warmer part load to full load at simultaneously desired lower component temperatures.

I claim:

1. A method for cooling an internal combustion engine, which comprises the steps of:

individually cooling individual components of the internal combustion engine including a cylinder head and/or a cylinder block; and adaptively controlling the cooling of at least one of the individual components by providing an adaptive controller for determining a degree of driving dynamics and regulating the cooling in dependence on the degree of driving dynamics.

2. The method according to claim 1, which further comprises using the adaptive controller to process dynamic data to regulate the cooling and to determine the degree of driving dynamics.

3. The method according to claim 2, which further comprises determining the dynamic data in a manner which is dependent on at least one of:

a request of a driver;

a throttle valve position;

a throttle valve gradient;

a rotational speed level; and a rotational speed gradient.

4. The method according to claim 2, which further comprises using the adaptive controller to process dynamic driving data as the dynamic data.

5. The method according to claim 1, which further comprises:

increasing the cooling in a case of a high degree of driving dynamics for sporty driving behavior or under full load; and decreasing the cooling in a case of a low degree of driving dynamics for a comfort driving style.

6. The method according to 1, which further comprises providing different dependences between the degree of driving dynamics and the cooling in a case of different ones of the individual components.

7. The method according to claim 1, which further comprises setting a temperature, via the adaptive controller, of the cylinder head below a temperature of the cylinder block constantly, independently of the degree of driving dynamics.

8. The method according to claim 1, wherein the internal combustion engine is for a motor vehicle.

9. A cooling system for an internal combustion engine, the cooling system comprising:

a split cooling system configuration where individual components of the internal combustion engine are cooled individually including a cylinder head and/or a cylinder block; and an adaptive controller controlling said split cooling system configuration for regulating cooling of at least one of the individual components, said adaptive controller determining a degree of driving dynamics and regulating the cooling in dependence on the degree of driving dynamics.

10. The cooling system according to claim 9, wherein said split cooling system configuration has a first valve and a second valve connected to said adaptive controller for controlling said split cooling system configuration.

11. The cooling system according to claim 10, wherein said first and second valves are each electric three-way valves.

12. The cooling system according to claim 10, wherein:

said first valve has an inlet side connected to the cylinder head and an outlet side connected in parallel to a radiator and to a bypass line bypassing the radiator; and said second valve has an inlet side connected to the cylinder block and an outlet side connected in parallel to the radiator and to the bypass line bypassing the radiator.

13. The cooling system according to claim 10, further comprising a radiator;

further comprising a bypass line bypassing the radiator;

wherein said first valve has an inlet side connected to the cylinder head and an outlet side connected in parallel to said radiator and to said bypass line bypassing said radiator; and wherein said second valve has an inlet side connected to the cylinder block and an outlet side connected in parallel to said radiator and to said bypass line bypassing said radiator.

14. The cooling system according to claim 10, wherein the internal combustion engine is for a motor vehicle.

* * * * *